US007650667B2

(12) United States Patent
Rosenzweig et al.

(10) Patent No.: US 7,650,667 B2
(45) **Date of Patent: *Jan. 26, 2010**

(54) ACTUATOR FOR STEAM MOP

(75) Inventors: Maximilian Rosenzweig, Montreal (CA); Vrdoljak Ognjen, Laval (CA)

(73) Assignee: Euro-Pro Operating, LLC, West Newton, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/842,478

(22) Filed: Aug. 21, 2007

(65) Prior Publication Data

US 2008/0034514 A1 Feb. 14, 2008

Related U.S. Application Data

(63) Continuation-in-part of application No. 11/769,521, filed on Jun. 27, 2007, and a continuation-in-part of application No. 11/496,143, filed on Jul. 31, 2006.

(51) Int. Cl.
*A47L 13/22* (2006.01)

(52) U.S. Cl. ..... 15/320; 15/401; 15/410; 401/1; 401/138; 401/270

(58) Field of Classification Search ..... 15/320, 15/401, 410; 401/1, 2, 137–139, 268–270; *A47L 11/03, A47L 13/22; A46B 11/08; B43M 1/02*
See application file for complete search history.

(56) References Cited

U.S. PATENT DOCUMENTS

| | | | | |
|---|---|---|---|---|
| 1,720,165 | A | 7/1929 | Bloom | |
| 2,053,282 | A | 9/1936 | Gewalt | |
| 4,073,030 | A | 2/1978 | Albishausen | |
| 4,074,387 | A | 2/1978 | Arato et al. | |
| 4,312,598 | A * | 1/1982 | Vagner | 401/1 |
| 4,327,459 | A | 5/1982 | Gilbert | |
| 4,584,736 | A | 4/1986 | Gremminger | |
| 4,905,712 | A | 3/1990 | Bowlin et al. | |
| 5,165,866 | A | 11/1992 | Kato | |
| 6,289,551 | B1 * | 9/2001 | Basile | 15/320 |
| 6,490,753 | B1 | 12/2002 | Chen | |
| 6,571,421 | B1 | 6/2003 | Sham et al. | |
| 6,584,990 | B2 * | 7/2003 | Shaw | 134/105 |
| 7,380,307 | B2 | 6/2008 | Tsai | |
| 2002/0094285 | A1 | 7/2002 | Paolini et al. | |
| 2002/0106970 | A1 | 8/2002 | Falla | |
| 2002/0112744 | A1 | 8/2002 | Besseling | |
| 2003/0089383 | A1 | 5/2003 | Biggs | |
| 2004/0134016 | A1 | 7/2004 | Kisela | |

(Continued)

FOREIGN PATENT DOCUMENTS

| | | |
|---|---|---|
| CH | 429 211 A | 1/1967 |

(Continued)

OTHER PUBLICATIONS

Patent Abstracts of Japan, vol. 2002, No. 03, Apr. 3, 2002, Publication No. 2001327449 (Alpha Homes: KK), Nov. 21, 2001.

(Continued)

*Primary Examiner*—David A Redding
(74) *Attorney, Agent, or Firm*—McCarter & English, LLP; Michael I. Wolfson

(57) ABSTRACT

A steam mop having a main body including a water pump and a boiler. Generation of steam is provided when the water pump is actuated by angular movement of the mop handle which changes the angle between the handle and mop head for operating a two way piston pump to pump water to the boiler. Steam is fed to a steam pad that may have a replaceable fabric pad fit snugly on the frame to distribute cleaning steam to the surface to be cleaned.

4 Claims, 5 Drawing Sheets

U.S. PATENT DOCUMENTS

| | | | |
|---|---|---|---|
| 2006/0000049 | A1 | 1/2006 | Rosenzweig |
| 2007/0130719 | A1 | 6/2007 | Zhou |

FOREIGN PATENT DOCUMENTS

| | | | |
|---|---|---|---|
| CN | 1368032 | A | 9/2002 |
| CN | 2540155 | Y | 3/2003 |
| CN | 2568117 | Y | 8/2003 |
| DE | 24 31 102 | A1 | 1/1976 |
| DE | 91 10 171 | U1 | 3/1993 |
| DE | 298 22 052 | U1 | 2/1999 |
| DE | 299 10 658 | U1 | 9/1999 |
| DE | 200 01 462 | U1 | 1/2001 |
| DE | 100 15 941 | A1 | 10/2001 |
| DE | 102 05 507 | A1 | 8/2003 |
| DE | 20 2006 001189 | U1 | 4/2006 |
| EP | 1 027 855 | A | 8/2000 |
| EP | 1 224 899 | A | 7/2002 |
| EP | 1 5554 968 | A | 7/2005 |
| FR | 601 312 | A | 2/1926 |
| FR | 709 689 | A | 8/1931 |
| FR | 2 282 252 | A | 3/1976 |
| GB | 1 449 483 | | 8/1973 |
| GB | 2 294 196 | A | 4/1996 |
| GB | 2 416 526 | A | 2/2006 |
| JP | 2001327449 | A | 11/2001 |
| JP | 2004337454 | A | 12/2004 |
| WO | WO 98/23385 | A | 6/1998 |
| WO | WO 99/26522 | A | 6/1999 |
| WO | WO 02/43550 | A | 6/2002 |
| WO | WO 2007/065371 | A | 6/2007 |

OTHER PUBLICATIONS

Euro-Pro Operating LLC; Steam Shark II Owner'S Manual Model EP908EF; Nov. 2003; St. Laurent, Quebec H4S 1A7, pp. 1-39.

Euro-Pro Operating LLC; Portable Shark Steam Cleaner Owner'S Manual Model SC505; Jan. 2003; p. 7; Champlain, NY 12919, pp. 1-11.

* cited by examiner

ACTUATOR FOR STEAM MOP

CROSS-REFERENCE TO RELATED APPLICATIONS

This is a continuation-in-part of U.S. applications Ser. No. 11/496,143, filed Jul. 31, 2006, and Ser. No. 11/769,521 filed Jun. 27, 2007.

BACKGROUND OF THE INVENTION

The invention relates generally to a steam mop, and more particularly to a steam mop including a water pump that is actuated by the angular movement of the mop handle to pump water from a reservoir to a boiler for generating steam to be distributed to a steam nozzle.

Conventional mops have been widely used for cleaning floors. However, conventional mops have not been effective at cleaning dirt in small crevices and floor gaps. In addition, conventional mops require frequent rising since mops can only effectively clean a small surface area at a time.

Steaming devices used to apply steam to household objects are well known. The uses of the devices vary widely, and may include the application of steam to drapes or other fabrics to ease wrinkles, and the application of steam to objects to assist in cleaning the objects.

In general, the nozzles used with the steam cleaners do not have large surface areas and a cloth to absorb the liquid condensate of the steam. Here, the fabric pad is secured to the nozzle by Velcro strips to a plurality of cleats on the bottom of the nozzle. In another embodiment, a flat fabric piece is folded around a flat brush or nozzle in order to increase the cleaning surface area. The folded fabric on top of the brush or nozzle is secured by a clip on top of the piece. Often steam injected behind the cloth passes through the cloth at the points the bristles contact on the cloth. This tends to wet the cloth and reduce the cleaning effectiveness of the steam. In addition, the cloth covers must be carefully attached not to cover the front or back of the brush attachment.

Recently steam mops wherein water is pumped from a reservoir to a boiling by the push-pull movement of the mop handle have been developed. This actuates a bellows pump or piston pump connected directly to the handle. These features are shown and described in parent application Ser. Nos. 11/496,143 and 11/769,525, the contents of which are incorporated here by reference in their entirety.

It remains desirable to provide improved ways to pump water from the reservoir to the steam boiler.

SUMMARY OF THE INVENTION

Generally speaking, in accordance with the invention, a steam mop having a water pump for selectively injecting water from a reservoir to a boiler in response to a change in the angle of the mop handle is provided. The mop includes a housing with an electric boiler and a water pump wherein movement of the mop handle changes the angle of an actuator operatively connected to the pump to pump water to the boiler for distribution of steam to a steam pad frame attachment for cleaning. A fabric steam pad is mounted on the steam pad frame to provide an improved cleaning surface.

Water is pumped to the boiler only when the angle between the actuator and mop head changes for generating steam to be fed to the mop head. This gives the user greater control over when water is pumped than in earlier proposals.

Accordingly, it is an object of the invention to provide a steam mop and having an improved pump actuator.

Another object of the invention is to provide a steam mop and actuator allowing a user to control when water is pumped to the boiler.

A further object of the invention is to provide a steam mop with a mechanical pump that is actuated by changing the angle between the mop handle and mop head.

Still other objects and advantages of the invention will in part be obvious and will in part be apparent from the specification.

The invention accordingly comprises a product possessing the features, properties, and the relation of components which will be exemplified in the product hereinafter described, and the scope of the invention will be indicated in the claims.

BRIEF DESCRIPTION OF THE DRAWINGS

For a fuller understanding of the invention, reference is made to the following description taken in connection with the accompanying drawing(s), in which.

DETAILED DESCRIPTION OF THE INVENTION

Figure 1:
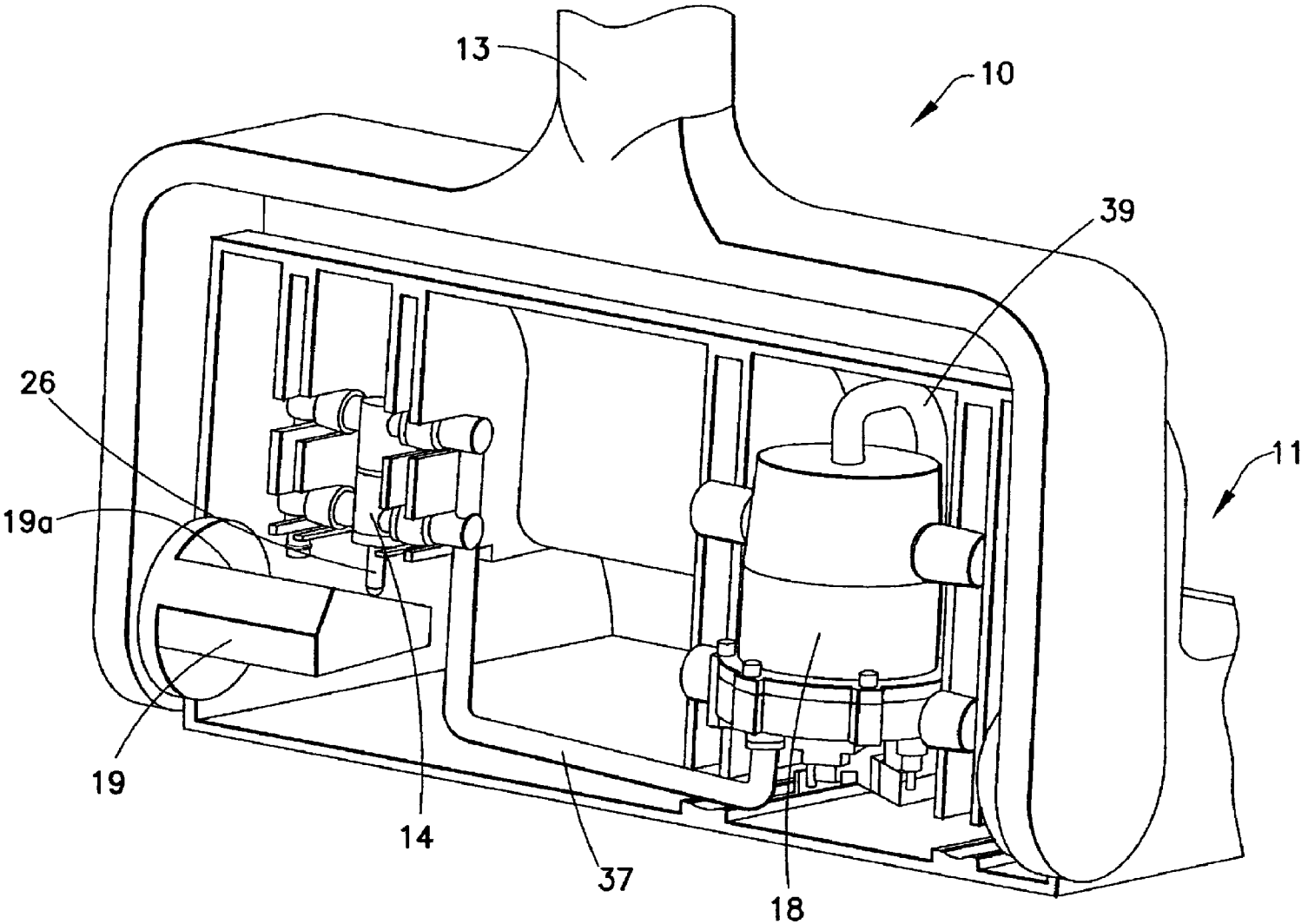
FIG. 1 is a schematic view in perspective of steam mop in section having a handle connected to a steam head having a pump actuator constructed and arranged in accordance with the invention.

FIG. 1 is a perspective view of the operative pumping elements of a steam mop 10 constructed and arranged in accordance with the invention. Mop 10 includes a housing or mop head 11 having a steam pad 12 connected thereto. A mop handle 13 is connected to mop head 11 by a paid of arms 13*a* that pivot about mop head 11. Mop head 11 includes a water pump 14 with a pump inlet 16 connected to a tank (not shown) and a pump outlet 17 connected to a water pipe 33 for supplying water to a boiler 18. Any type of mechanical pump or some other means of feeding water to the boiler may be used with steam mop 10. Preferably, pump 14 is a mechanical pump, such as a bellows pump or a piston pump, that is actuated by movement of mop handle 11. Water pipe 33 is connected to boiler 18 for generating steam to be distributed to steam pad 12.

In this embodiment pump 14 is a two-way piston pump having an actuator 19 connected to handle 13 at arm 13*a* for pivoting. Pump 14 includes a piston 24 with an extending piston rod 26 in a caming relationship with a cam surface 19*a* of actuator 19. Operation of pump 14 is as shown in FIG. 5 and will be described below.

Figure 2:
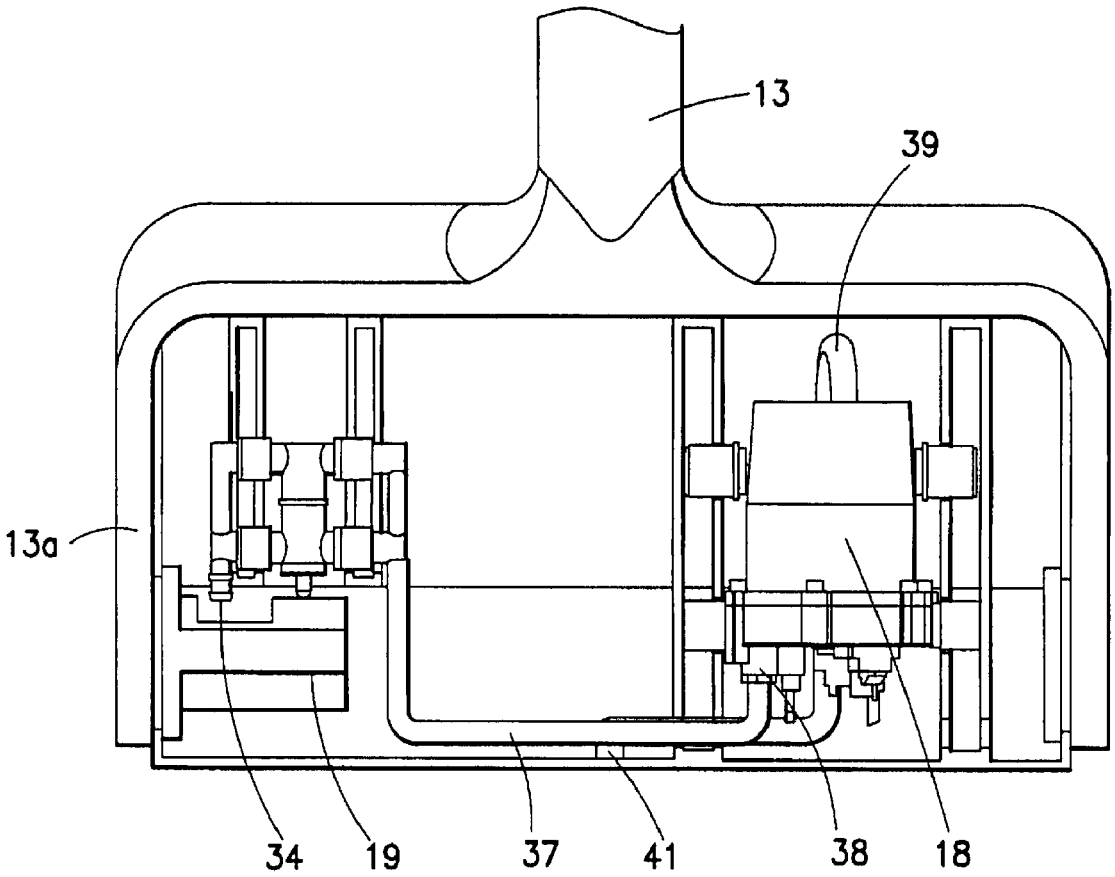
FIG. 2 is a plan view in section of the steam mop of FIG. 1.
Figure 3:
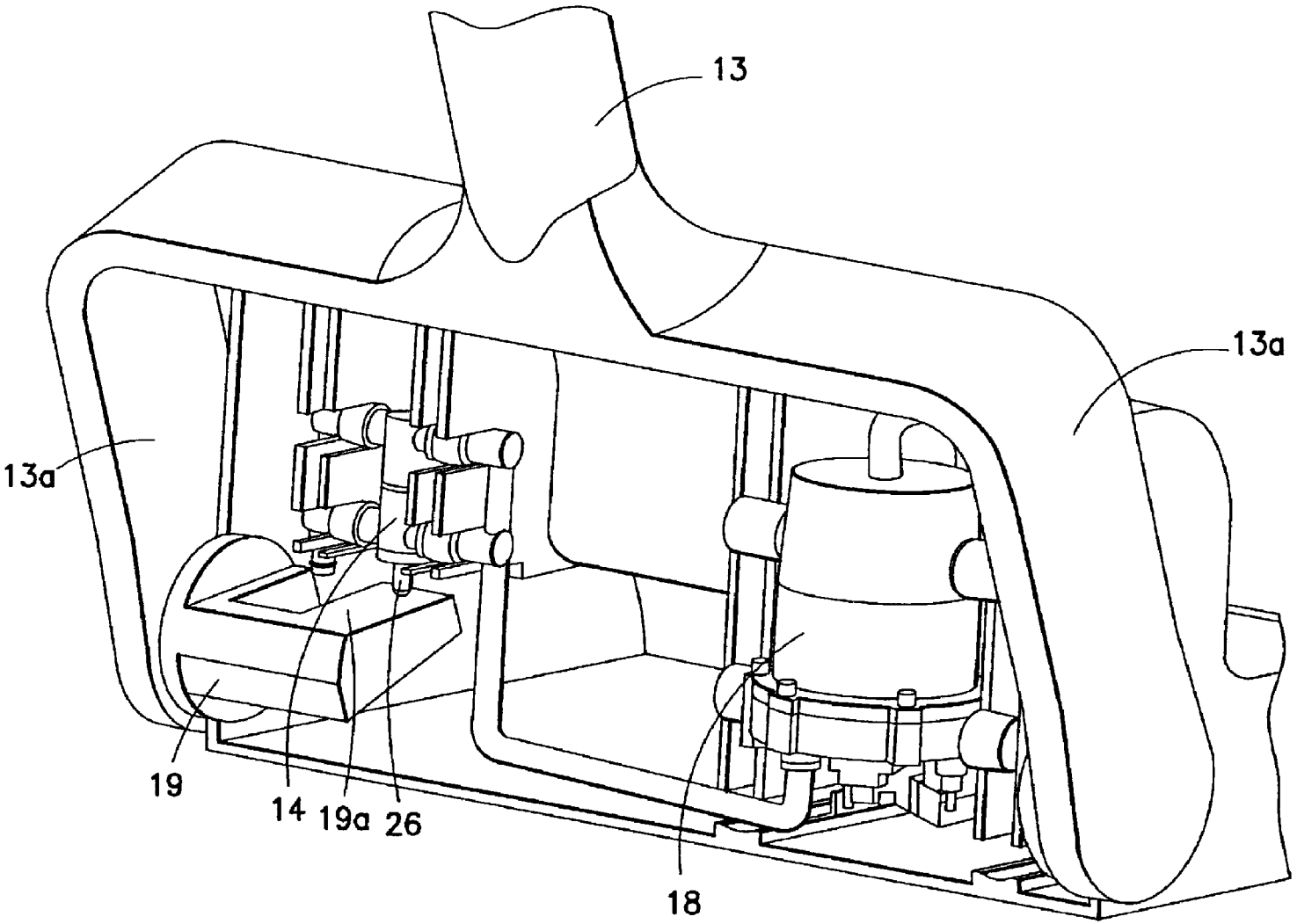
FIG. 3 is a schematic showing the actuator of FIG. 1 in a first position of an increased angle with the piston depressed into the pump cylinder.
Figure 4:
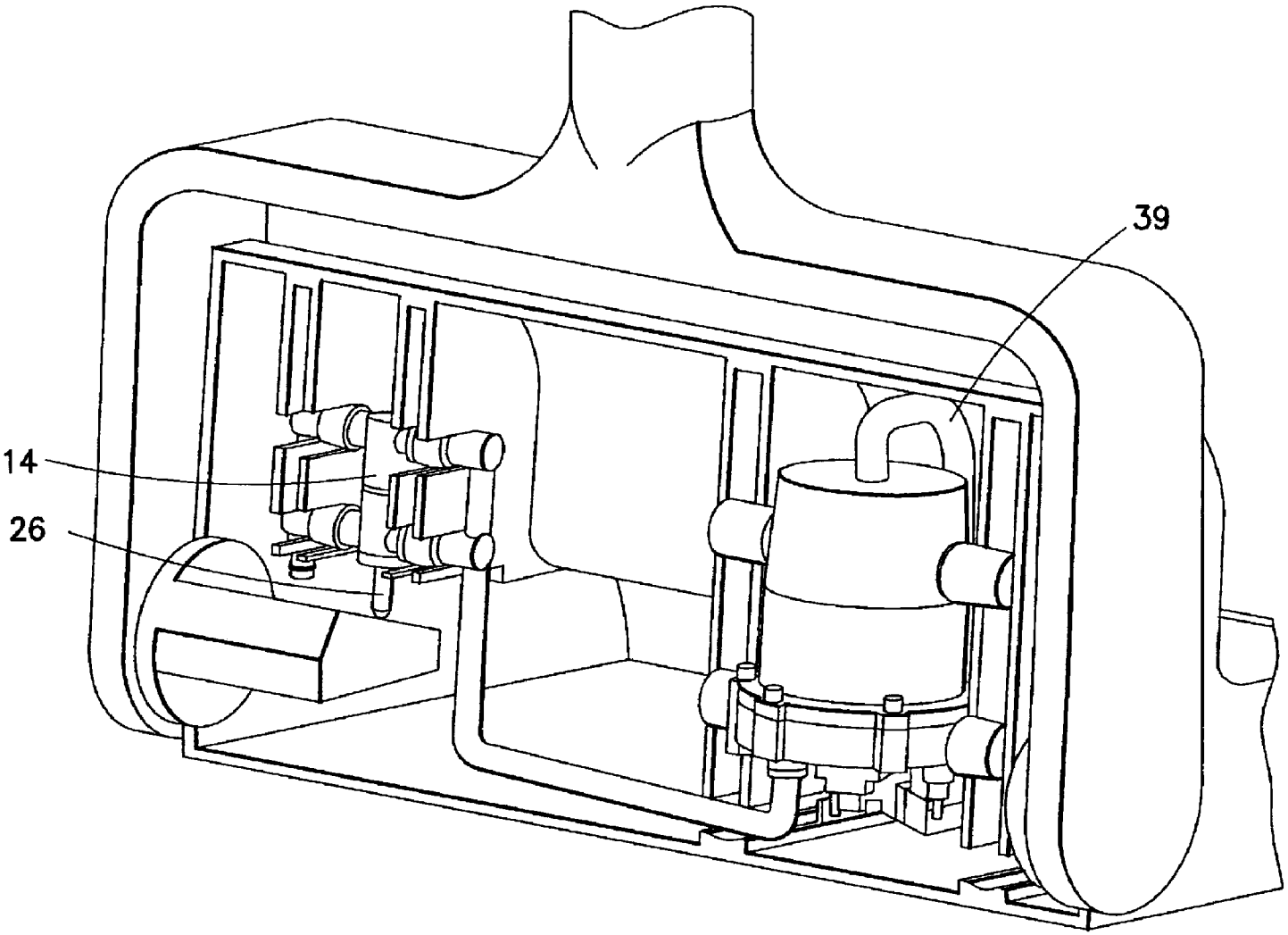
FIG. 4 is a schematic showing the actuator of FIG. 1 in a second position of a lesser angle with the piston extending away from the pump cylinder.

FIG. 2 shows steam mop 10 in plan view. FIG. 3 shows handle 13 connected to pump actuator 19 at an increased angle with piston rod depressed into pump 14. FIG. 4 shows piston rod 26 extended as the angle between handle 13 and head 12 is decreased. Piston rod 26 is biased towards actuator 19.

Steam mop 10 provides many advantages for ease of use because it eliminates the need for an electric water pump and an on/off switch to activate the electric water pump. Here, the user has control over the amount of water fed to the boiler and consequently, how much steam is needed by pivoting the mop handle. In addition, steam mop 10 is designed as a low pressure or non-pressurized system so it is safer for the user to use. Further, since the amount of water routed to the boiler is controlled, the boiler can create steam in a short amount of time.

Figure 5:
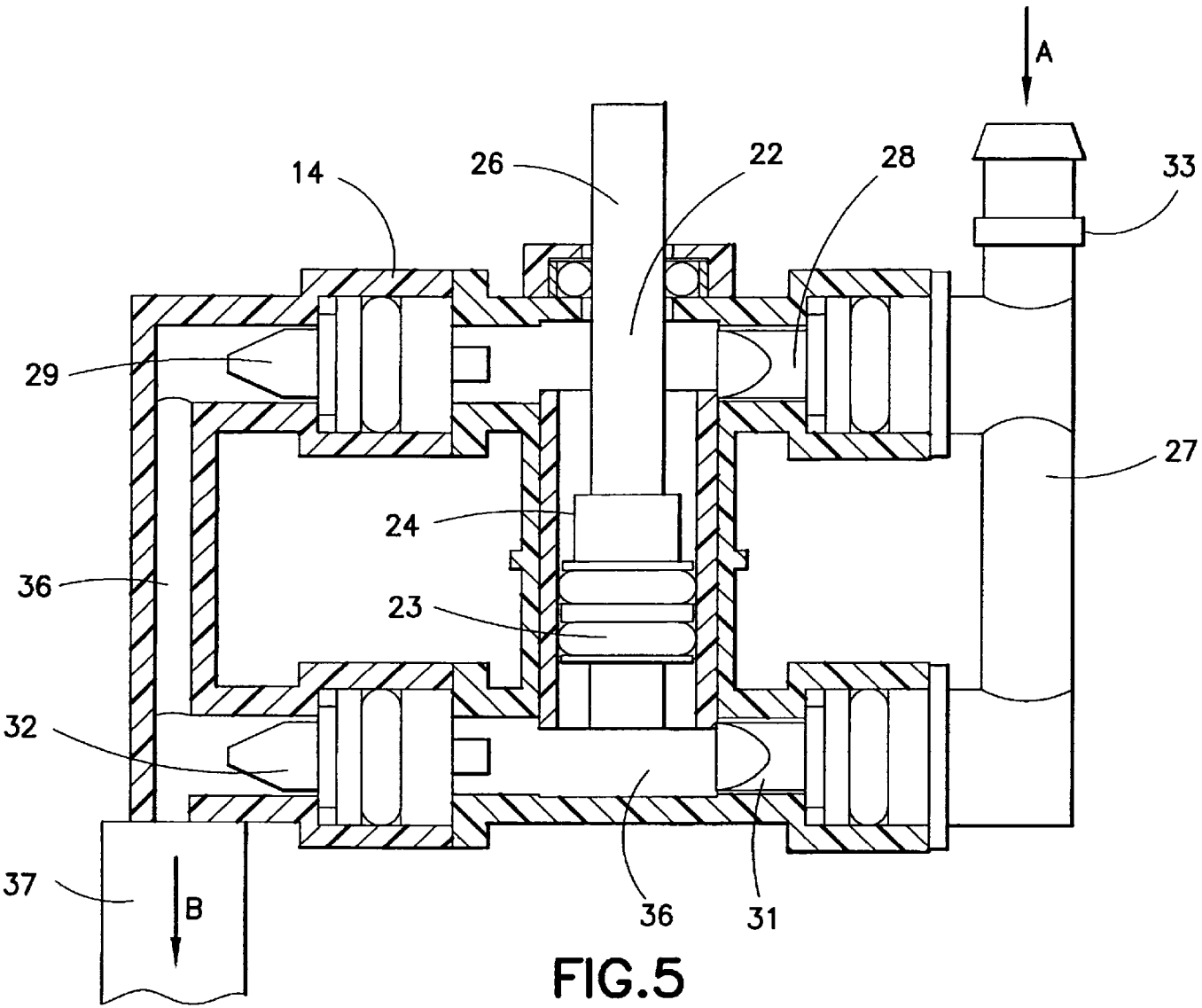
FIG. 5 is a sectional view of a two way pump suitable for use in the steam mop in FIGS. 1-4.

Referring now to FIG. 5, pump 14 will pump water when piston 24 is displaced both in the forward motion and also in the return backwards motion. Pump 14 includes a pump cylinder 21 having an upper chamber 22 and a lower chamber 23 divided by piston 24 that is connected to piston rod 26 which moves up and down in response to movement of an actuator 19 coupled to handle 13. Piston rod 26 is normally biased downwardly towards actuator 19 so as to engage and ride on cam surface 19*a*.

A first inlet unidirectional duck bill valve 28 and a first outlet unidirectional duck bill valve 29 are connected to upper chamber 22. A second inlet unidirectional duck bill valve 31 and a second outlet unidirectional duck bill valve 32 are connected to lower chamber 23. As shown in FIG. 5, both inlet duck bill valves 28 and 31 are connected in parallel to a water inlet pipe 27 having a water inlet fitting 34 for securing a hose from the water tank. Water outlet duck bill valves 29 and 32 are connected in parallel to a water outlet pipe 36 that is secured to a water outlet hose 37 connected to boiler 18 at an inlet 38.

In order to create the pumping action to force water out of valves 29 and 32, volume changes in chambers 22 and 23 must be created. Volume changes in pump cylinder 21 is caused by the movement of piston 24 it is displaced in response to the angular displacement of handle 13 and actuator 19.

In accordance with the invention, piston 24 is displaced in response to a change in angle of handle 13 and mop head 11. Actuator 19 connected to handle 13 has an inclined surface 19*a* in caming relationship with piston rod 26 that is biased toward it. As the angle between handle 13 and housing 11 increases, actuator caming surface 19*a* moves away from pump 14 and piston rod 26 is displaced downwardly. Conversely, as the angle decreases, piston rod 26 is displaced upwardly.

As piston 24 is moving downward with piston rod 26, the volume of lower chamber 23 decreases which causes the water which is inside to exit chamber 23 through duck bill valve 32. Water flow direction is determined by the direction of a duck bill valve. Water can flow only in one direction through a duck bill valve. At the same time water flows through outlet valve 32, the volume of chamber 22 increases. This increase of the volume causes water to flow from the reservoir into chamber 22 through inlet duck bill valve 28 as shown by arrow A. Water flows to boiler 18 through water hose 37 as shown by arrow B.

A steam hose 39 is connected to boiler 18 of any suitable design, which can be used to distribute steam in the desired pattern. Water inlet can be connected with any suitable connection (rubber hose, direct connection to a water tank, etc) to the water supply to enable pump 14 to pump and deliver the water to boiler 18.

Steam mop 10, provides many advantages for ease of use because it eliminates the need for an electric water pump and an on/off switch to activate the electric water pump. Here, a change of the angle between handle 13 and mop head 11 allows the user has more control over the amount of water to be discharged into the boiler. In addition, steam mop is designed as a low pressure or non-pressurized system so it is safe for use. Further, since the amount of water routed to the boiler is controlled, the boiler can create steam in a short amount of time.

A fabric steam pad frame is typically placed over steam pad 12 for effective steam cleaning.

It will thus be seen that the objects set forth above, among those made apparent from the preceding description, are efficiently attained and, since certain changes may be made in the above product without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

The present invention may be embodied in other specific forms without departing from the spirit or essential attributes of the invention. Accordingly, reference should be made to the appended claims, rather than the foregoing specification, as indicating the scope of the invention. A steam mop having a pump that pumps water from a water container to a steam generator in response to movement of the mop handle with the steam fed to a fabric pocket cover in accordance with the invention provides a vast improvement over electrical pumps. The pump may include a two-way valve that pumps water in response to both the push and pull of the mop.

What is claimed is:

1. A steam mop, comprising:

a mop body including a water source and a mechanical water pump including a piston actuated in response to movement of a pump element, and a boiler in the body a mop handle connected to the mop body;

the pump having an inlet connected to the water source and an outlet connected to the boiler;

an actuator having a caming surface mounted for rotation on the body adjacent to the piston, the actuator rotated in response to rotation of the mop handle; and the pump piston is biased towards the caming surface of the actuator, wherein a change in angular orientation of the actuator in response to a change in angle of the handle causes the piston to be displaced and pump water from the water source to the boiler.

2. The steam mop of claim 1, wherein the pump is a mechanical piston pump with a one-way inlet valve and a one-way outlet valve.

3. The steam mop of claim 2, wherein the valves are substantially conical in shape and made of a substantially flexible material.

4. The steam mop of claim 1 wherein the pump is a two-way mechanical pump, comprising:

a pump cylinder having a first end and a second end with a first unidirectional inlet valve and a second unidirectional inlet valve at the first end and a second unidirectional outlet valve and a second unidirectional outlet valve at the second end;

a piston dividing the cylinder into a first chamber and a second chamber with the respective inlet and outlet valves connected thereto with the first and second inlet valve connected to a water source and the outlet valves connected to a water receiver;

whereby movement of the piston towards the second end expels water out of the second chamber through the second outlet valve and draws water into the first chamber through the first inlet valve and movement of the piston towards the first end expels water out of the first chamber through the first outlet valve and draws water into the second chamber through the second inlet valve.

* * * * *